United States Patent [19]

Kaplan

[11] 3,944,867

[45] Mar. 16, 1976

[54] SHADOW MASK HAVING RIBS BOUNDING RECTANGULAR APERTURES

[75] Inventor: Sam H. Kaplan, Chicago, Ill.

[73] Assignee: Zenith Radio Corporation, Chicago, Ill.

[22] Filed: Mar. 15, 1974

[21] Appl. No.: 451,622

[52] U.S. Cl. ..... 313/403; 313/456

[51] Int. Cl.[2] ..... H01J 29/06; H01J 29/07

[58] Field of Search ..... 313/402, 403, 407, 408, 313/422, 470, 105

[56] References Cited

UNITED STATES PATENTS

| | | | |
|---|---|---|---|
| 2,236,041 | 3/1941 | Teal | 313/105 |
| 2,579,665 | 12/1951 | Green | 313/408 X |
| 2,942,133 | 6/1960 | McGee | 313/105 X |
| 3,041,489 | 6/1962 | Veith | 313/105 X |
| 3,229,142 | 1/1966 | Kalibjian | 313/105 X |
| 3,663,854 | 5/1972 | Tsuneta et al. | 313/403 |
| B395,478 | 1/1975 | Orthuber | 313/95 X |

*Primary Examiner*—Robert Segal

[57] ABSTRACT

A shadow mask for use in a color cathode ray tube to insure that a given electron beam impinges only on a given portion of the cathode ray tube screen. The mask comprises a webbing or sheet of relatively thin, electrically conductive material which defines a mask plane and which has therein a periodic array of electron transmissive apertures. The sheet includes a periodic array of ribs and/or dimples extending out of the plane of the mask to impart substantial rigidity to the mask.

2 Claims, 11 Drawing Figures

SHADOW MASK HAVING RIBS BOUNDING RECTANGULAR APERTURES

FIELD OF THE INVENTION

This invention relates to shadow masks for color cathode ray tubes and is principally directed to a novel mask structure having improved mask self-rigidity.

BACKGROUND OF THE INVENTION

Any color selecting shadow mask may be thought of as an electrically conductive or electron opaque webbing which insures that a given electron beam impinges only on a given portion of a CRT (cathode ray tube) screen. Conventionally, shadow masks comprise a thin (typically 0.006 inch) apertured sheet of metal, and must generally assume a curvature similar to the curvature of the CRT screen with which the mask cooperates. For spherically curved screens, the mask is generally likewise spherically configured and must be capable of self-maintaining its sphericity. Spherically configured dot masks (i.e., shadow masks of the type used with dot triad tubes) offer relatively high structural strength and are adequately self-rigid to maintain their sphericity.

Slit masks (i.e., those color selection electrodes which do not have circular apertures but rather an array of vertically oriented slits separated horizontally by columns of electron opaque material) are not self-rigid, cannot self-maintain sphericity, and instead must be supported in a cylindrical or planar contour. Since a cylindrical or planar configuration in a thin sheet or wire grid format is not self-supporting, such slit masks must be stretched taut in order to assure stability and precision in the location of the slits relative to the associated phosphor screen. As a consequence, a very rigid, heavy and costly frame must be provided for tensing a conventional slit mask. Other problems such as vibration of the electrically conductive slats or wires which are used to define the slits are also present in this type of mask. Examples, of slit masks of the type described may be found in U.S. Pat. Nos. 3,363,129, 3,573,528 and 3,638,063.

The structural disadvantages of the slit mask have been overcome to some degree by the slot mask. Slot masks are similar to slit masks since slot mask apertures comprise columns of vertically oriented slits horizontally separated by columns of electron opaque material. However, the slits are interrupted vertically by horizontal strips of metal known as "tie-bars" which act as strengthening bridges across the slits. Thus each slit becomes a plurality of slots. Conventionally, the tie-bars are provided in sufficient number and with sufficient individual width to impart enough structural strength to the mask to allow it to self-maintain a spherical or other curved configuration. However, since the slot mask tie-bars intercept a portion of the phosphor-exciting electron beams, the structural strength requirements, which dictate that the tie-bars be sufficiently wide and numerous, impose a predetermined maximum bound on electron beam transmission and in turn on reproduced picture brightness. Moreover, the slot mask tie-bars if sufficiently wide, may interfere with the electron beam raster pattern to form moire' patterns which may seriously degrade the reproduced picture quality.

Attempts to increase self-rigidity in any type mask by increasing thickness of the mask material encounter problems arising in standard etching and stretch forming methods of manufacture and create a detrimental hole close-down at non-zero beam angles.

OBJECTS OF THE INVENTION

It is a general object of this invention to provide a shadow mask having improved self-rigidity.

It is a more specific object to provide a slot mask having reduced electron beam interception by tie-bars.

It is a further specific object to provide a self-rigid slit mask.

DESCRIPTION OF THE DRAWINGS

Further objects, features and advantages of the invention will become apparent in the following description and accompanying drawings in which.

DESCRIPTION OF THE PREFERRED EMBODIMENTS

Figure 1:
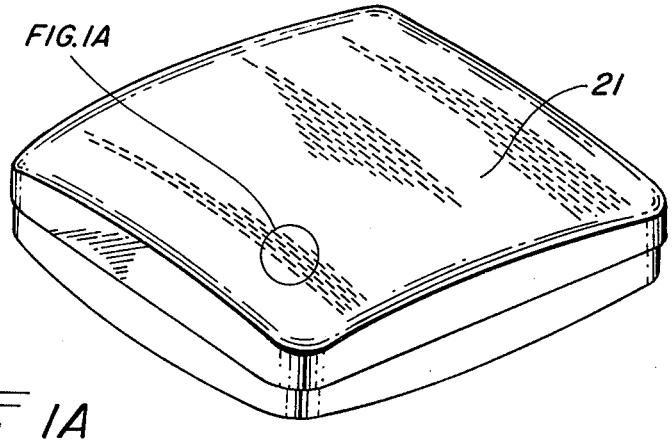
FIG. 1 is a perspective view of a spherically configured shadow mask.
Figure 1A:
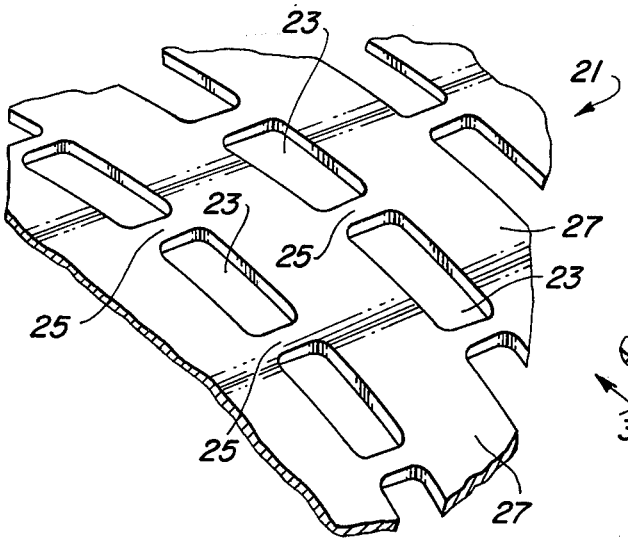
FIG. 1A is a magnified perspective view of a spherically configured prior art slot mask.

FIG. 1 macroscopically illustrates a prior art spherically configured slot mask 21. As seen in FIG. 1A, which depicts a magnified portion of the slot mask of FIG. 1, the mask 21 includes an array of slot apertures 23 which comprise the individual electron-transmissive windows and which are framed by the electrically conductive mask webbing material. More specifically, the slots are separated vertically by tie-bars 25 and horizontally by slats 27. All the slots in the mask of FIG. 1A are located on an imaginary surface whose shape is spherical, i.e., the "plane of the mask". In this example, the "plane of the mask" is an imaginary spherical surface but more generally the "plane of the mask" will be used herein to mean the imaginary surface on which all the individual electron windows lie. As seen by the above example, the plane of the mask may be spherical. The plane of the mask may also be cylindrical or otherwise curved. The plane of the mask may also be flat. It should also be apparent that the plane of the mask is not dependent on the shape of the apertures. That is, the apertures may be slots, slits, round apertures or otherwise.

Continuing to refer to the FIG. 1A prior art slot mask, it is seen that the mask webbing material also lies in the plane of the mask. That is, the slats and tie-bars also follow the basic spherical curvature shown in FIG. 1A. Thus, these prior art masks possess very little rigidity.

In accordance with one aspect of this invention, a shadow mask is provided which has relatively thin ribs extending out of the plane of the mask. The ribs serve to impart substantial rigidity to the mask. In accordance with another slightly different aspect of the invention, a mask is provided having dimples extending out of the plane of the mask and functioning substantially similarly to the above ribs.

A shadow mask constructed in accordance with the principles of this invention may assume a variety of configurations. The drawings and associated descriptions illustrate only a few specific embodiments falling within the broader scope of the inventive principles disclosed herein. Other embodiments employing the inventive principles disclosed herein will be apparent to those skilled in the art. It is also to be understood that although the drawings depict slot masks whose plane is spherical, the principles of the invention are not so limited. The principles of the invention are equally applicable to shadow masks whose apertures are other than slots and are also equally applicable to shadow masks whose plane of the mask is otherwise curved or even flat.

Figure 2:
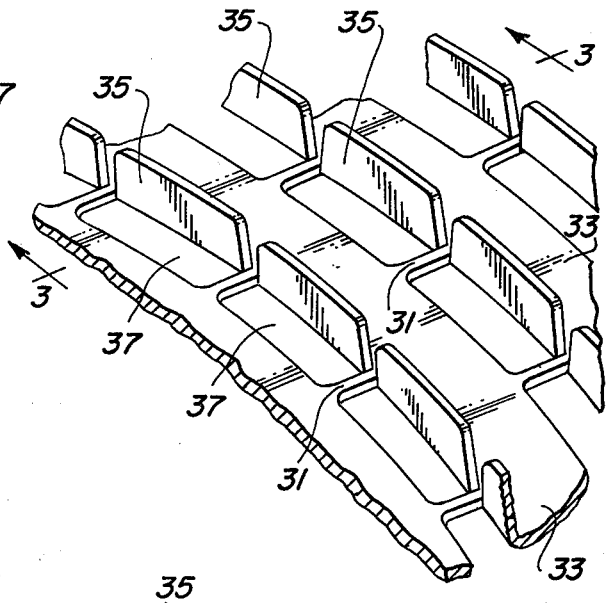
FIG. 2 is a magnified perspective view of a spherically configured shadow mask embodiment implementing the principles of this invention.
Figure 3:
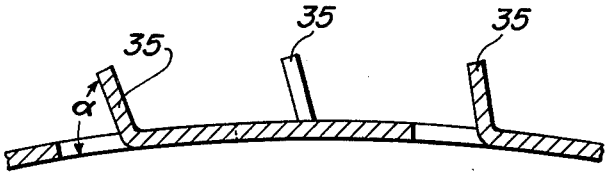
FIG. 3 is a cross-sectional view taken along line 3—3 of FIG. 2.

Paralleling the FIG. 1A manner of illustration, FIGS. 2 and 3 depict a magnified portion of a specific slot mask embodiment constructed in accordance with the principles of this invention. This slot mask includes tie-bars 31 and slats 33 which lie in the plane of the mask and in addition includes a plurality of relatively thin, rigidity-imparting ribs 35 extending away from the plane of the mask. In the FIGS. 2 and 3 embodiment each rib 35 takes the form of a lip extending away from the periphery of an associated slot 37. It should be noted that depending on the angle $\alpha$ at which a lip extends away from the plane of the mask, the lip may, or may not, serve at least in part to define the associated electron transmissive slot 37. In other embodiments the angle $\alpha$ may vary from slot to slot, for instance in a predetermined relation to the variations in incidence angle of beam or mask. Such variations are well known to those skilled in the art and occur because the center of deflection does not coincide with the mask geometric center. In other inventive embodiments herein set forth, analogous applications of these variations will be apparent to those skilled in the art.

It should also be pointed out that although all ribs of FIGS. 2 and 3 are illustrated as extending from only one side of the plane of the mask, this is not essential. Some or all ribs may be reversed so as to extend from the other side. One example incorporating such a modification includes ribs which are alternately directed toward and then away from an associated cathode ray tube face panel. Analogous variations of hereinafter disclosed embodiments will be apparent to those skilled in the art.

Methods of producing the mask of FIGS. 2 and 3 will be apparent to those skilled in the art. For instance a purely mechanical process may be employed. A flat sheet of metal without apertures may be stretch formed similar to the stretch forming of apertured sheets as described in U.S. Pat. No. 3,296,850. More specifically, a flat blank is mounted in a press in which cooperating die elements clamp the flat blank at the edges and while thus clamped, the blank is shaped by stretch forming it over a suitably configured punch.

Apertures and ribs are then produced in the spherical sheet by lancing the sheet at three edges of each intended aperture and then folding or bending the material along the fourth edge so as to produce the aperture and the protruding rib. The lancing and bending may be accomplished with appropriate mating dies which themselves are producible to the required dimensions by present-day milling machines.

Another method of producing the shadow mask in FIGS. 2 and 3 is by electroforming. The necessary mandrel should be apparent to those skilled in the art. It would include conductive surfaces on which the slats, tie-bars and ribs could form, and insulating surfaces to prevent deposition where apertures are intended.

It should be pointed out that a mask similar to that of FIGS. 2 and 3, but with relatively few tie-bars, or even with no tie-bars such as a slit mask, could be produced with only slight, and apparent, variations in the above-described procedures for producing slot masks.

Figure 4:
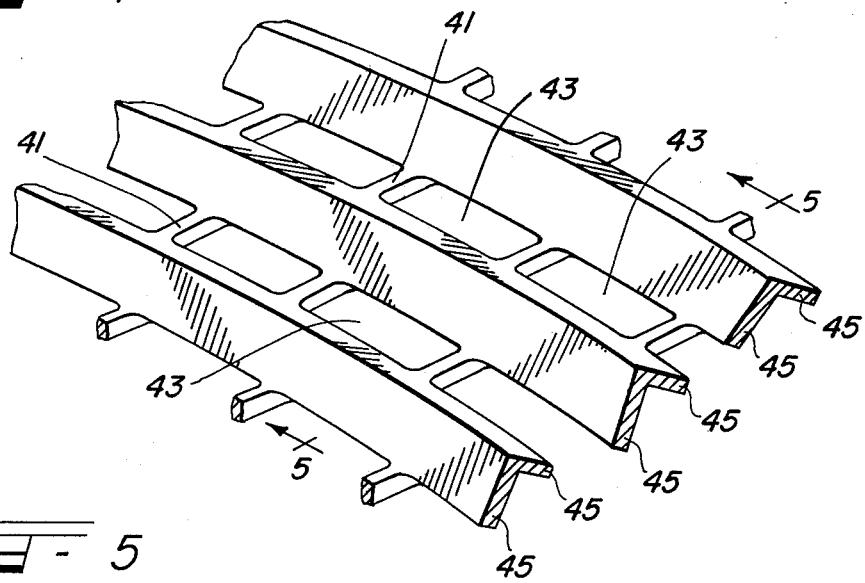
FIG. 4 is a magnified perspective view of a preferred embodiment of a spherically configured shadow mask implementing the principles of this invention.
Figure 5:
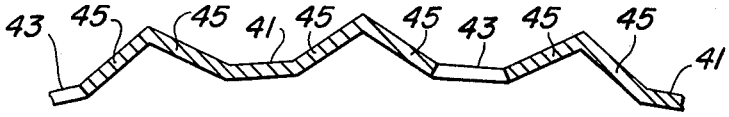
FIG. 5 is a cross-sectional view taken along line 5—5 of FIG. 4.

The specific mask embodiment depicted in a magnified fashion in FIGS. 4 and 5 is also a presently preferred embodiment. In this embodiment the horizontal tie-bars 41 which vertically separate the slots 43, constitute the major portion of the webbing material which remains in the plane of the mask. Most of the webbing material extends out of the plane of the mask in the form of ribs 45 and imparts substantial rigidity to the mask. Each rib of the FIGS. 4 and 5 mask may be described as a portion of a slat folded toward the remaining slat portion along a vertical line. Thus, the ribs occur in joined pairs to produce channels which are essentially inverted "V" shaped and which are the functional equivalents of prior art flat slats. It should be kept in mind that although the above description is illustrative, it may not be precise, because to actually fold the flat slat of an operational flat slot mask would likely alter, probably undesirably so, the horizontal periodicity of the slots. In other words the desired slot periodicity should be of course achieved independently of the forms the webbing material assumes. It is also apparent that other similar shapes, such as a "U" shaped channel, are possible.

The increase in rigidity will permit the tie-bars to be thinner and/or fewer in number. The resulting mask thus intercepts less of the electron beams and approaches a slit mask in performance. If the channels are made high enough (out of the plane of the mask), the tie-bars may be eliminated altogether, resulting in a true slit mask having adequate self-rigidity to self-maintain a spherical or other configuration.

Electroforming is presently considered to be the preferred method of producing a mask as shown in FIGS. 4 and 5. The mandrel illustrated in FIG. 6, except for obvious design nuances which prevent problems such as too much or too little localized deposition, may be employed to electroform the mask in FIGS. 4 and 5. Insulating islands 51 prevent the deposition of material and thus define the slots 43 of FIG. 4. The mask ribs 45 form on the channel-like conductive surfaces 53 and the mask tie-bars form on the conductive surfaces 55 between insulating islands 51. Of course, all angles are chosen such that the completed electroformed mask may be withdrawn from the mandrel.

The mask of FIGS. 4 and 5 or one similar thereto, may also be mechanically produced. First, a flat non-apertured sheet may be stretch-formed, as earlier explained, into a spherical or other desired three-dimensional configuration. The channels may be added by forming between appropriate mating dies or by coining. Aternatively these operations could be combined by stretch draw forming with mating dies. Perforating the channelized spherical blank to create the slots should be performed last so as to locate the slots independently of any localized shifts of material during forming operations. The perforations may be made with an appropriate punch and die. The necessary tolerances are well within the art of piercing intricate patterns. See page 134 of *Metals Handbook*, 8th edition, Volume 4-Forming, American Society for Metals, 1969.

Figure 7:
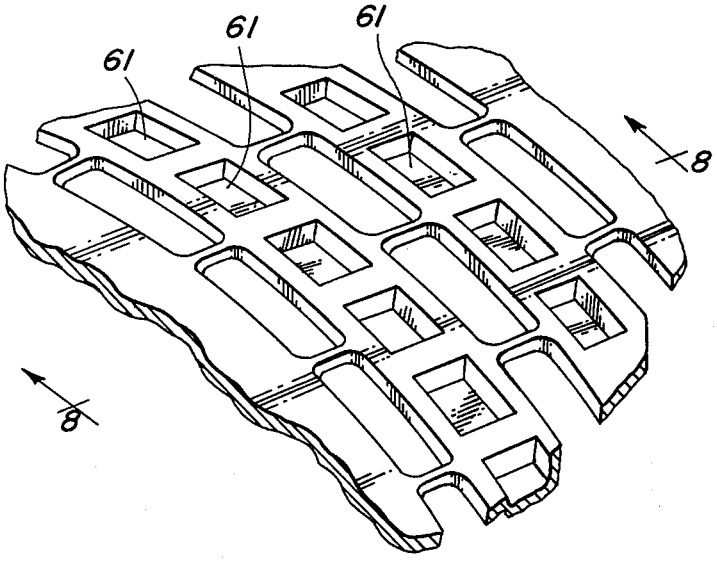
FIG. 7 is a magnified perspective view of another spherically configured shadow mask embodiment implementing the principles of the invention.
Figure 8:
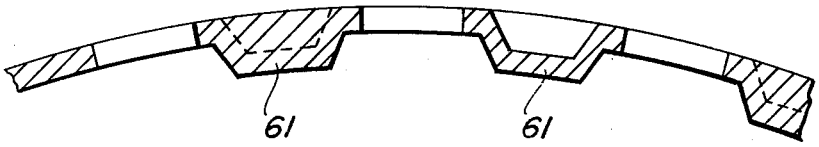
FIG. 8 is a cross-sectional view taken along line 8—8 of FIG. 7.

FIGS. 7 and 8 depict a mask embodiment also implementing the principles of the invention, but whose construction represents a slight departure or variation from the theme characterized by ribs as set forth above and illustrated with the two foregoing examples. The mask of FIGS. 7 and 8 also includes material which projects out of the plane of the mask and thus imparts rigidity to the mask. However, the form of the FIGS. 7 and 8 projections are more appropriately described as dimples 61. The depicted dimples comprise somewhat rectangular depressions preferably located in the mask slat areas. Although illustrated as extending from only one side, some or all of the depressions may be reversed. Thus the depressions may extend from either or both sides. Also, the dimples may assume various configurations other than the depicted embodiment. Especially in view of the previous descriptions it should be apparent to those skilled in the art that such a mask with dimples could be produced by electroforming or by mechanical procedures which, for example, could include a coining operation.

Figure 9:
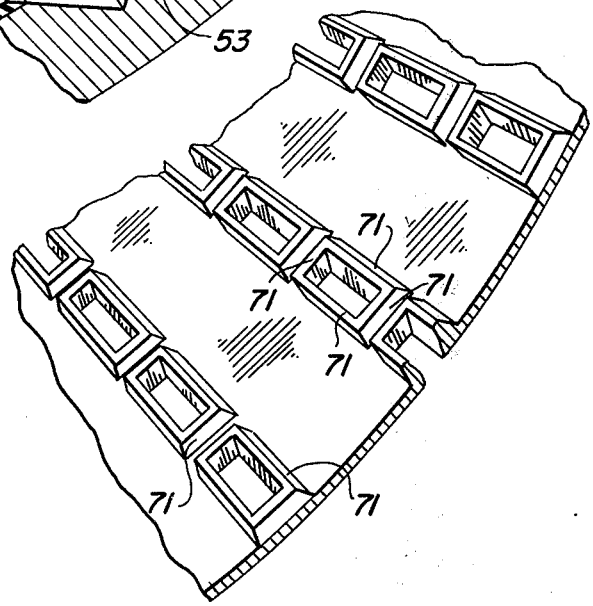
FIGS. 9 and 10 are magnified perspective views of further embodiments of spherically configured shadow masks implementing the principles of this invention.
Figure 10:
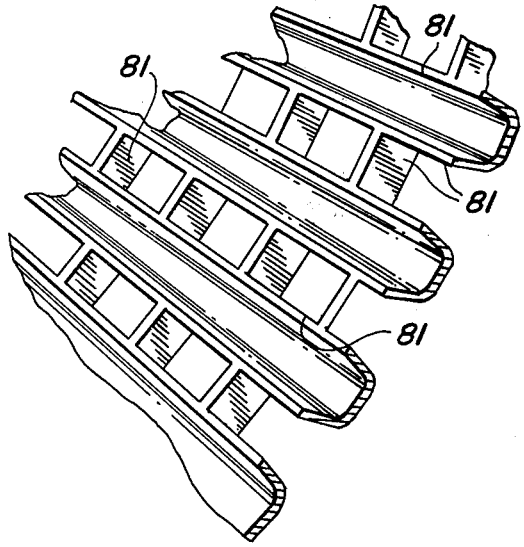

Other desirable mask embodiments employing ribs are illustrated in FIGS. 9 and 10. In FIG. 9, as in FIG. 2, the ribs 71 take the form of lips extending from aperture peripheries except, of course, that the lips surround the slot instead of projecting only from one edge of the periphery. The ribs 81 of FIG. 10 are similar to the lips of FIG. 9 except that part of each lip is shared by a neighboring slot. In other words, the two ribs which occur at neighboring ends of adjacent slots, as shown in FIG. 9, are joined or otherwise modified to become a single rib as shown in FIG. 10. Also, similar to FIG. 4, some of the ribs of FIG. 10 occur in joined pairs to produce channels. Although not shown, a further desirable embodiment is achieved by adding, to the FIG. 10 channels, ribs which, for instance, may extend substantially transversely across the channels and appear substantially as lateral extensions of the ribs shown as defining slot ends.

Figure 6:
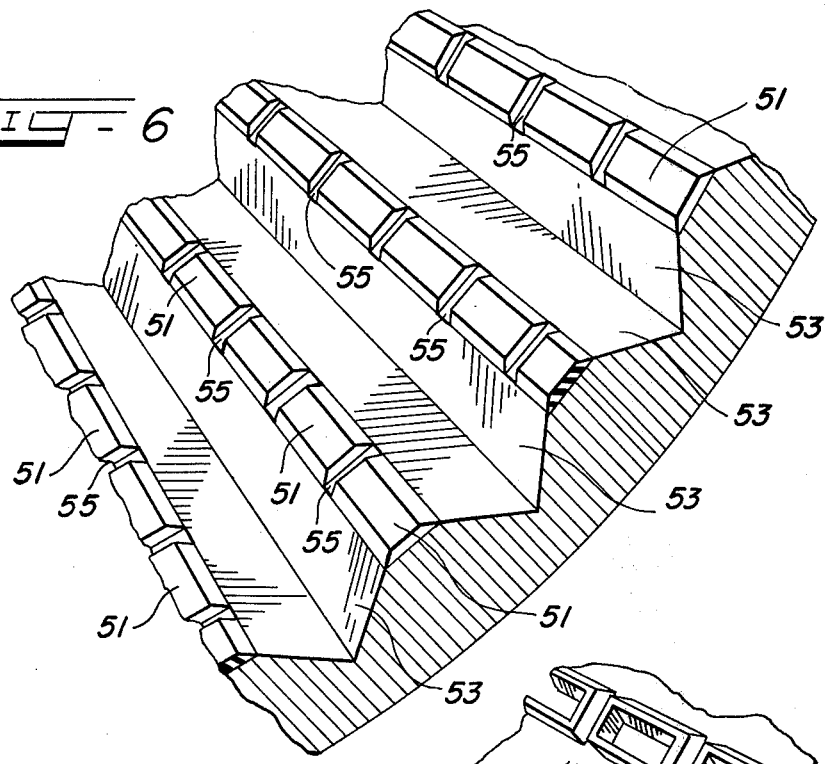
FIG. 6 is a magnified perspective view of a mandrel for electro-forming a shadow mask implementing the principles of this invention.

Such a mask as illustrated in FIG. 9 could be electroformed on a mandrel similar to that shown in FIG. 6 but modified to lower the conductive surfaces between insulating islands such that the insulating islands rest on truncated pyramids whose four sides are conductive. The V-groove is also modified to more of a U-shape. A mandrel for the mask of FIG. 10 is similar to that for FIG. 9 except that only three sides of each pyramid is conductive.

Thus, it is seen that the above-described examples are merely illustrative of the application of the principles of the invention. Numerous other arrangements may be readily devised by those skilled in the art which will embody the principles of the invention and fall within the spirit and scope thereof.

What is claimed is:

1. A shadow mask for use in a color cathode ray tube comprising a relatively thin, spherically curved sheet of electrically conductive material which defines a spherical mask plane and which has therein a periodic array of elongated, rectangularly shaped electron transmissive apertures, said periodic array forming a plurality of columns, each of said apertures being bounded on one of the longer sides thereof by a rib out-struck from the sheet and extending from the convex side thereof for imparting rigidity to the mask and for defining, at least in part, the electron transmissive aperture.

2. A shadow mask as defined in claim 1 wherein said apertures and said out-struck ribs are disposed in rows arranged end-to-end, each aperture being separated from its neighbors by tie bars, in alternate rows said apertures and associated ribs being staggered to enhance the mechanical rigidity imparted to the mask by said ribs.

* * * * *